United States Patent [19]

Jennings

[11] 3,979,923

[45] Sept. 14, 1976

[54] PREASSEMBLED REFRIGERANT SUBCOOLING UNIT

[76] Inventor: John H. Jennings, 9 Turtle Creek Drive, Tequesta, Fla. 33458

[22] Filed: Aug. 4, 1975

[21] Appl. No.: 601,646

[52] U.S. Cl. ..... 62/184; 62/305; 165/39; 236/99 D

[51] Int. Cl.[2] ..... F25B 39/04

[58] Field of Search ..... 62/183, 184, 305; 165/39; 236/99

[56] References Cited

UNITED STATES PATENTS

| | | | |
|---|---|---|---|
| 2,016,587 | 10/1935 | Beckman | 62/305 X |
| 2,318,161 | 5/1943 | Johnson et al. | 62/184 X |
| 2,577,903 | 12/1951 | McGrath | 236/99 X |
| 2,610,479 | 9/1952 | Iwashita | 165/136 X |
| 3,177,929 | 4/1965 | Jennings | 62/183 X |

*Primary Examiner*—William E. Wayner
*Attorney, Agent, or Firm*—Macdonald J. Wiggins

[57] ABSTRACT

A preassembled unit for subcooling the refrigerant in existing air conditioning and refrigeration systems to a temperature less than its saturated vaporization temperature. The unit is installable in existing refrigeration systems and has the capability to increase the efficiency of such systems. A coaxial tube heat exchanger includes a refrigerant tube to be connected between the system condenser and expansion valve, and a cooling medium tube through which a flow of cooling water is provided. A thermostatically-operated control valve is utilized to adjust the flow of water in response to the refrigerant outlet temperature. The control valve ensures that only the minimum quantity of water necessary to reduce the refrigerant temperature to a selected value is used. The heat exchanger and control valve are completely enclosed in a block of plastic foam to prevent a high ambient temperature from affecting these elements. An alternative embodiment of the invention includes a spray head to be attached to an air-cooled condenser and arranged to discharge the outlet cooling water so as to impinge on the condenser heat exchange surfaces. The resultant evaporation of the water removes additional heat from the condenser and contributes to an additional increase in system efficiency.

6 Claims, 6 Drawing Figures

PREASSEMBLED REFRIGERANT SUBCOOLING UNIT

BACKGROUND OF THE INVENTION

This invention relates to a preassembled refrigerant subcooling unit adapted to be universally installable into existing air conditioning and refrigeration systems, and having the capability to increase the efficiency thereof, resulting in a reduction of operating time, and to improvements in such subcooling units.

This invention is an improvement over my U.S. Pat. No. 3,177,929 entitled "Refrigeration Subcooling Unit" that teaches a preassembled refrigerant subcooling unit with a primary object of increasing the cooling capacity of an existing refrigerating unit. During the period subsequent to the issuance of this patent, the United States has experienced severe shortages of energy with subsequent significant increases in costs of electrical power. My prior invention, as may be recognized by those skilled in the art, can reduce the operating costs of a refrigeration system into which it is installed when the system is operated at its original design capacity. Therefore, my earlier invention is advantageous and applicable for systems having adequate cooling capacity for the purpose of saving energy, as well as for its original purpose.

My original subcooling unit, while eminently suited and economical for its primary purpose, has several disadvantages for installation in small air conditioning systems of the home type. For example, it is most desirable to mount a subcooling unit for a building air conditioner adjacent to the condensing unit. For air-cooled condensing units, the usual mounting is outside of the building, allowing the heat to be rejected to the outside atmosphere. The design and bulk of my original unit makes an outside mounting difficult. Also, the high ambient air temperatures encountered in summer weather can reduce the degree of subcooling possible with my prior design. Another problem is that the preferred embodiment of my prior invention causes the water flow utilized for subcooling to be controlled by the refrigerant pressure as the compressor of the system is cycled, and in many cases, more water flow than is necessary will occur and possible savings will be reduced by such wastage.

In the present invention, I have disclosed newly-discovered means for overcoming the problems inherent in my earlier invention when it is desired to use a subcooling unit for reducing the energy used for cooling purposes, and in particular for small, home-type air conditioners that have the condensing unit mounted outside a building.

SUMMARY OF THE INVENTION

As is well known in the art, the refrigerant in the condenser of an air conditioner or refrigerating unit will condense to a liquid at the temperature determined from its pressure and type of refrigerant. Most air-cooled condensers do not have sufficient capacity to cause the temperature of the condensed fluid to drop below this value. However, it is also well known that subcooling the liquid will increase the cooling efficiency of the system, due to the increased capacity of the subcooled refrigerant for absorbing heat and the reduction or elimination of flash gas in the evaporator. It has been determined that the increase in efficiency obtainable by this means is approximately one percent for each 2°F of subcooling of conventional halogenated refrigerants. My invention utilizes a coaxial double-tube heat exchanger arranged for flow of a refrigerant between the outer and inner tubes, and for the flow of a coolant such as water through the inner tube. Liquid refrigerant leaving an air-cooled condenser, which may be in the temperature range of 105°F, to 125°F, is introduced into the heat exchanger. Cooling water is allowed to flow through the inner tube and absorb heat from the refrigerant by conduction through the inner tube wall, thereby accomplishing subcooling. For water supplies with temperatures in the 70°to 85°F range, significant gains in efficiency will result in accordance with my invention.

A novel temperature-controlled water flow valve is provided at the refrigerant outlet end of the heat exchanger. The valve controls the flow of cooling water into the heat exchanger in response to the outlet temperature of the refrigerant, in a counter flow arrangement. This control action advantageously provides a modulation of the water flow to the exact average amount needed for the desired subcooling, thereby preventing waste of water. The heat exchanger and water control assembly is embedded in a block of plastic foam material that serves the dual purpose of: (1) preventing high ambient air temperatures and solar heat from reducing the efficiency of the heat exchanger by flow of such heat through the outer tube wall, and (2) providing mechanical protection for the components of the heat exchanger. My improved preassembled subcooler unit design is further configured to use readily-available and low-cost components; thus, the initial cost of installing my invention in existing refrigeration systems is minimized, and such cost can be amortized in a reasonable time with the savings therefrom.

An alternative embodiment of my invention provides a novel method of using the water flow from the heat exchanger to further improve the overall system efficiency of an existing refrigeration or air conditioning system, and to reduce the average water consumption of my subcooling unit. In this embodiment, the output or drain line from the heat exchanger has attached thereto a nozzle device. This nozzle device is adjusted and positioned to spray the output water onto the cooling fins of the air-cooled condenser of the system. As may be understood, the nozzle may be configured to suit the particular condenser design with which it is used. The water is caused to be incident on the condenser fins in the direction of the cooling air flow. The result of this water spray is to significantly increase the efficiency of the condenser by removing refrigerant vapor super heat and additional refrigerant liquid heat by both evaporation and conduction. This action results in a reduction of the compressor load and the current drain of the compressor from the power line. For example, tests have shown a 20 percent reduction in line current. The lower condenser exit refrigerant temperature resulting also will reduce the required water flow for subcooling. Thus, in accordance with this facit of my invention, additional energy savings will be obtained.

It is therefore an object of my invention to provide a refrigerant subcooling unit that is preassembled in the form of a convenient package for installation in existing air conditioning and refrigeration systems.

It is a further object of my imvention to provide a preassembled refrigerant subcooling unit that is capable of increasing the operating efficiency of the cooling system into which it is installed, thereby reducing the energy consumption thereof and the operating costs of the system.

It is yet another object of my invention to provide a preassembled refrigerant subcooling unit that can be marketed at a low cost, whereby the original cost can be amortized over a reasonable period through the savings therefrom.

It is still another object of my invention to provide a preassembled refrigerant subcooling unit wherein water is utilized as a coolant for subcooling the liquid refrigerant, and temperature-sensitive automatic control means is provided for limiting the flow of water to the minimum amount required and usable for such subcooling of the refrigerant.

It is yet a further object of my invention to provide a preassembled refrigerant subcooling unit in which the heat exchanger is physically protected from damage and insulated from high ambient air temperatures.

It is still a further object of my invention to provide a preassembled refrigerant subcooling unit to be installed in an air conditioning system that has an air-cooled condenser, wherein water is used for subcooling and discharged as a spray so as to cause evaporative cooling of the air-type condenser to desuperheat the vapor and remove additional condenser heat, thereby further increasing the system efficiency.

These and other objects, features, and advantages of my invention will be more clearly seen by reference to the detailed description of my invention hereinbelow.

DESCRIPTION OF THE PREFERRED EMBODIMENT

Figure 1:
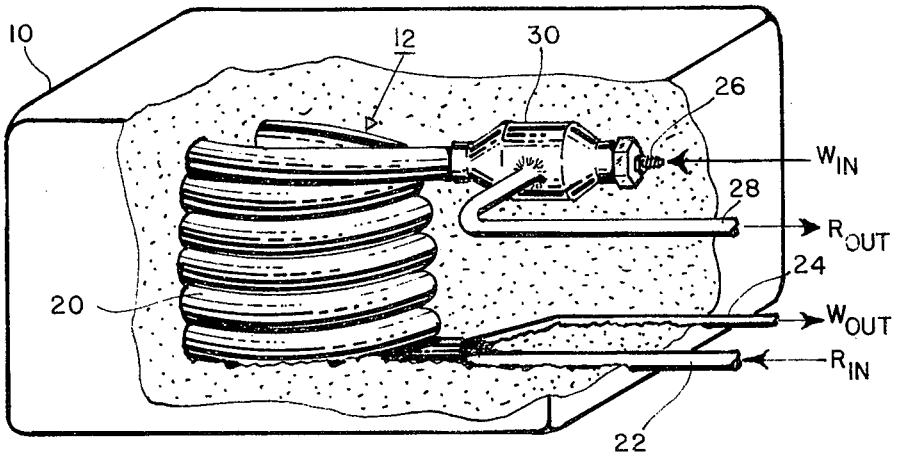
FIG. 1 is a perspective view of a preassembled refrigerant subcooling unit in accordance with my invention in which the protective and insulating plastic foam-encapsulating material is partially cut away to expose the heat exchanger and the relationship of the unit components.

Referring to FIG. 1, a partially cut away view is shown of the preferred embodiment of my invention. The components visible in this view are: the heat exchanger unit 12 having a coiled outer tube 20, an inlet line 22 for the refrigerant, an outlet tube 28 for the refrigerant, a water inlet fitting 26, a water outlet tube 24, a control valve housing 30, and a plastic foam protective and insulating coating 10. As may be recognized, the plastic foam coating has been partially cut away to expose the components, and actually has the form of a rectangular block. The components enumerated above will be described in more detail hereinafter.

Figure 2:
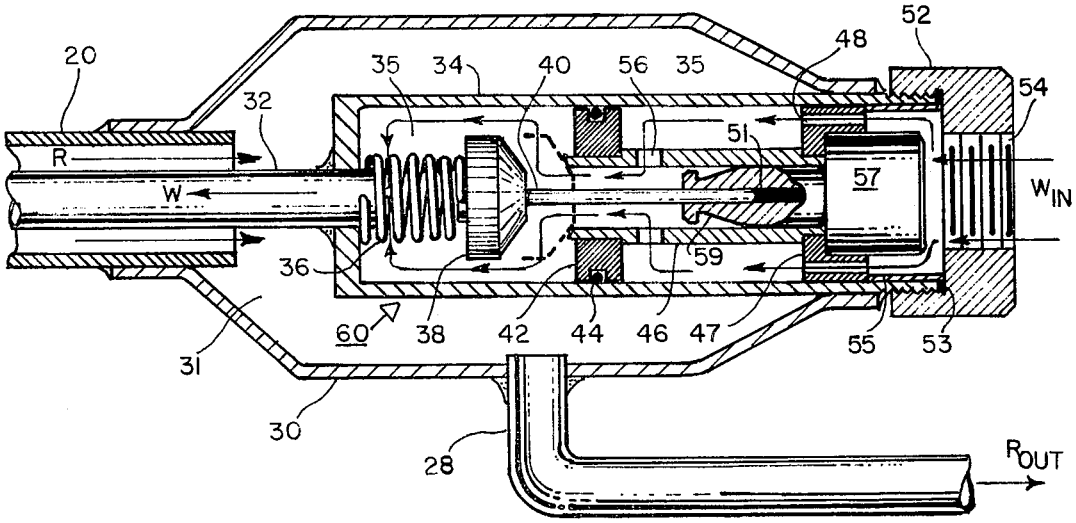
FIG. 2 is a cross-sectional view of the temperature-operated water coolant flow control valve.

Heat exchanger 12 comprises an external steel tube 20 which may have an outside diameter of five-eighths-inch and an internal copper tube 32 disposed coaxially within tube 20 as seen in FIG. 2. Inner tube 32 may be three-eighths-inch OD. The coaxial heat exchanger tubing is preferable coiled as shown in FIG. 1 to conserve space. The length of the heat exchange tubing is determined by the air conditioning system size and the subcooling capacity desired. In an exemplary design suitable for a home air conditioner, the outside diameter of the coil is 6 inches and contains 6 loops. It is to be understood that the size of the heat exchanger is determined by the capacity of the air conditioner and the amount of subcooling desired. In use, the refrigerant to be subcooled enters heat exchanger 12 via tube 22 ($R_{in}$) and flows through the annular space defined by tubes 20 and 32. Cooling water enters the device through fitting 26 ($W_{in}$), flows through inner tube 32, and exits heat exchanger 12 via tube 24 ($W_{out}$). Thus, the water flow is counter to the refrigerant flow. The copper tube 32 efficiently transmits heat from the liquid refrigerant into the cooling water, thereby lowering the temperature of the refrigerant. The flow of water from inlet fitting 26 to tube 32 is controlled by a valve located within control valve housing 30, as will be described below. The subcooled refrigerant flowing from tube 20 into valve housing 30 exits heat exchanger 12 via tube 28 ($R_{out}$).

FIG. 2 is a cross-section of control valve housing 30 showing the details of the control valve contained therein. Housing 30 has its inner end brazed or welded to the end of heat exchanger outer tube 20. Valve body 34 is inserted through the outer end of housing 30 and welded thereto. As may be noted, coaxial inner tube 32 projects from the end of outer tube 20 into the inner end of valve body 34 and is welded thereto. Tube 28 is welded through the wall of housing 30 to provide an outlet for the refrigerant. As may now be recognized, tube 20, housing 30, valve body 34, and inner tube 32 form a hermetically-sealed outer space 31 to contain liquid refrigerant surrounding valve 60, and an inner space 35 through which water can flow to inner tube 32.

Figure 3:
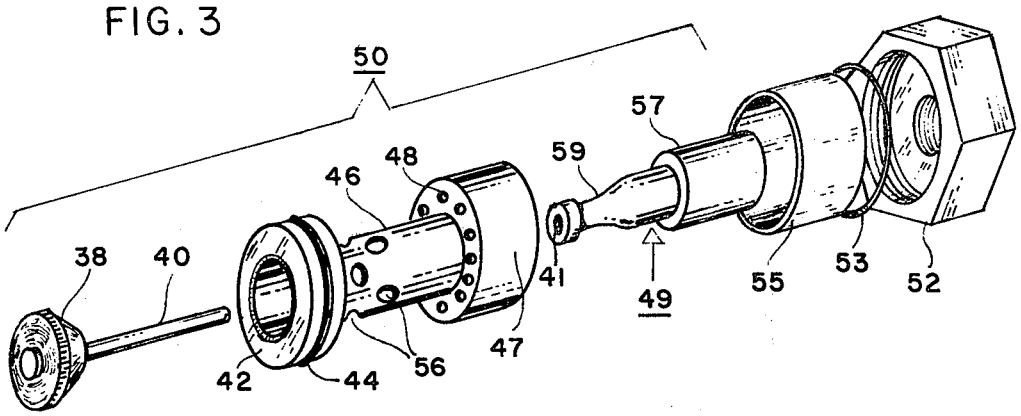
FIG. 3 is an exploded view of the thermostatic valve mechanism used in the flow control valve.

Referring to FIG. 3, a thermostatic valve assembly 50 is shown in exploded view. The assembly 50 is disposed within valve body 34 as illustrated in FIG. 2. Water entering cap 52 through opening 54 impinges on ring 47 and flows through annular passages 48 located around the periphery of ring 47. Tubular inner valve body 46, concentric with ring 47 and attached thereto at one end as shown, has seal ring 42 and seal 44 disposed at its other end, and a set of holes 56 through its tubular wall. As may now be seen, water incoming through passages 48 cannot pass seal 44, and therefore is constrained to flow through holes 56. Assuming that the system conditions require subcooling, in accordance with my invention the water is permitted to flow thence into valve body 34 and therethrough to inner tube 32. To control the flow of water, I have provided thermostatic control means utilizing a thermostatic power device 49 as the sensing and motive element. Power device 49 is disposed in the outer end of ring 47, as best seen in FIG. 2.

Thermostatic power device 49 is preferably a readily-obtainable device used as the temperature-sensitive element in the majority of automobile radiator thermostats in the United States. This key element of my invention is available in a wide range of operating temperatures and at very low cost due to the high production rate thereof. A typical unit that is well-suited for use in my invention is the Model 98067-H manufactured by the Robertshaw Controls Company, which may be built to operate in the 80° to 90°F range. As seen in FIG. 3, power device 49 consists of a heat sink 57, body 59, and thermally-expansive medium 51 (FIG. 2). In operation, rod 40 is inserted in a hole 41 concentric with body 59 contacting therein medium 51. When heat sink 57 reaches the selected operating temperature, expansion of medium 51 forces rod 40 outward for a distance of appeoximately three-eighths inch.

Rod 40 has attached at its other end a valve washer 38 utilized to control the water flow through valve assembly 50. In the assembled view of control valve 60 in FIG. 2, rod 40 is shown in its extended position characteristic of heat sink 57 being above its operating temperature. In this position, water flows essentially unrestricted into heat exchanger inner tube 32. When the heat sink 57 temperature drops below the selected operating temperature, medium 51 contracts and compression spring 36 disposed between valve washer 38 and end of housing 34 forces rod 40 into its retracted position. As shown by the dotted lines in FIG. 2, valve washer 38 seats on the end of inner valve body 46, completely blocking the water flow into tube 32. Thermostatic valve assembly 50 has been designed to be readily removable from body 34 for repair or for changing the operating temperature. To this end, power unit 49 is fastened within ring 47 with epoxy cement or other suitable means, forming an integral unit. The unit is a press fit within body 34 by virtue of the diameter of ring 47 and seal 44. The unit may be withdrawn when necessary with a suitable tool. During assembly and after assembly 50 is pressed into place, spacer 55 is inserted, and cap 52 with washer 53 is screwed onto the threaded end of body 34. To remove assembly 50, cap 52 and spacer 55 are removed. A special tool is used to grasp heat sink 57 and to apply a pulling force, thereby extracting the assembly.

Figure 4:
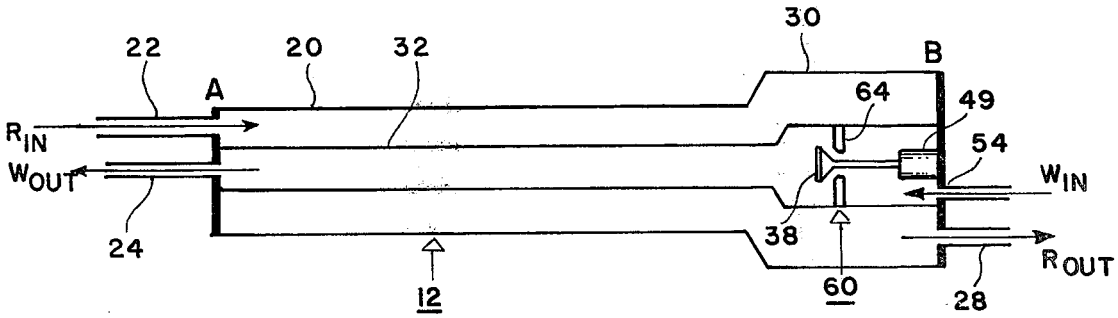
FIG. 4 is a schematic diagram of the heat exchanger used in my invention, including the means used to modulate the coolant flow.
Figure 5:
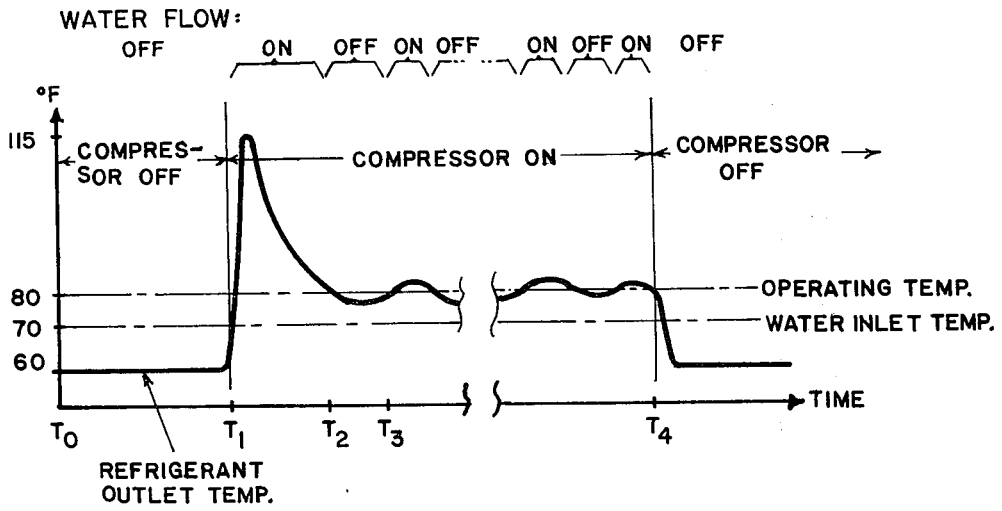
FIG. 5 is a graph showing the outlet temperature of the refrigerant as a function of time for a typical application of my invention, showing the manner in which the flow of coolant water is advantageously modulated during the "Compressor ON" phase.

Having now described in detail the construction of the preferred embodiment of my invention, I will explain the specific operation by use of the schematic diagram of FIG. 4 and the temperature graph of FIG. 5. In FIG. 4, heat exchanger 12 is indicated diagrammatically as outer tube 20 and inner tube 32. It is to be understood that these tubes are concentric and FIG. 4 represents a cross-section thereof. The enlarged portion at end B represents control valve housing 30 and contains a schematic representation of control valve 60. Consider liquid refrigerant entering the tube 22 at end A, thence into heat exchanger outer tube 20. The refrigerant flows therethrough and exits at end B via tube 28. Assume for illustration that the system compressor has just turned ON and that water control valve 60 is in its closed or OFF position due to thermostatic power valve unit 49 being below its operating temperature. Valve washer 38 is in this condition closed against seat 64 and water entering via inlet 54 is prevented from entering inner tube 32.

The liquified refrigerant flowing in tube 20 will initially be at its condensing temperature. For illustrative purposes, I will use a fluid temperature of 115°F. An important feature of my invention as seen from FIG. 2 is that the liquid refrigerant completely surrounds temperature control valve 60. This advantageous construction ensures rapid heat transfer to heat sink 57 of power unit 49. Returning to FIG. 4, the heat from the refrigerant causes power unit 49, assumed to have an operating temperature of 80°F, to move washer 38 away from seat 64, admitting a flow of cooling water into tube 32. Heat will then flow from the liquid refrigerant through the walls of tube 32 and will be absorbed by the cooling water flowing therethrough and carried out via exit tube 24 at end A.

It may be noted that I specify that the cooling water flow counter to the refrigerant flow. As will be explained, this feature of my invention is used to control the volume of water flow to the minimum essential for maximum subcooling, advantageously preventing waste of water. This operation may be more easily understood with reference to FIG. 4 and FIG. 5. FIG. 5 is an exemplary time plot of the refrigerant temperature during a compressor ON-OFF cycle and indicates periods during which the water flow is ON and OFF, respectively. Starting at time $T_0$ to time $T_1$, the compressor is shown to be OFF. The refrigerant in the heat exchanger will be at a low pressure and at a relatively low temperature, for example 60°F. Assuming that thermostatic power device is selected to open valve 60 at temperatures above 80°F, valve 60 will be closed and no water will flow during the period $T_0$ to $T_1$.

At time $T_1$, the compressor turns ON in response to the system requirement for cooling. The gas pressure is greatly increased to the point that the refrigerant in the condenser is at its saturated vaporization temperature and therefore becomes liquid as additional heat is removed by the condenser. The liquid refrigerant as it leaves the condenser may be, for example, at 115°F. The flow of refrigerant will quickly fill heat exchanger 12 and outer control valve housing 30 with liquid refrigerant. Due to the unique construction of my control valve 60, inner control valve housing 34 is surrounded by the 115°F liquid. Heat flow to power device 49 by conduction is then very rapid, causing it to open valve 60 allowing cooling water to flow and exit by tube 24. Assuming the cooling water is at 70°F as it enters at end B of heat exchanger 12, the cooling action therefrom will cause the entering liquid refrigerant to become progressively cooler as it flows toward end B, and to be a minimum at exit tube 28. The desired temperature for the refrigerant at exit tube 28 is 80°F in this example, in accordance with the selected calibration of power unit 49.

In accordance with my invention and assuming a sufficient volume of cooling water, I automatically maintain the average refrigerant outlet temperature at the selected 80°F. As shown in FIG. 5, as the outlet temperature drops from 115° to 80°F between times $T_1$ and $T_2$, the thermostatic control turns the water flow OFF. While the figure indicates a sharp cutoff for simplicity, it is to be understood that it is actually a gradual on-off action. Due to the normal thermal lags, the refrigerant will then cool slightly below 80°F and thereafter begin to warm up as the water flow ceases. As shown at time $T_3$, the liquid approaches 80°F, causing the water valve to turn ON again. This water flow modulation will continue in accordance with my invention until time $T_4$, when the compressor is turned OFF in response to the system cooling requirements. At this time, the refrigerant reverts to its low temperature condition and the water flow stops completely. As readily seen, the ON-OFF modulation of the water flow thus obtained controls the average flow to the exact volume required to achieve the desired subcooling without regard to the cooling system environmental parameters within the range of control provided. As may be understood, if control valve 60 were at the refrigerant inlet end A, continuous input of high-temperature refrigerant would prevent the desired water modulation control, and the water flow would not be dependent on the refrigerant exit temperature as desired. As is evident, the temperatures used for illustration may be varied without departing from the scope of my invention.

The advantageous action of the water volume control just described is one key to achieving an object of my invention to increase the operating efficiency of a cooling system into which it is installed. It is emphasized that this action is obtained by the features of surrounding control valve 60 with refrigerant and providing high thermal conductivity to thermal power element 49; and by locating valve 60 at the refrigerant outlet end of heat exchanger 12.

Another feature of my invention that contributes to its efficiency of subcooling is the means provided to prevent flow of ambient heat into the outer wall of tube 20. As may be recognized, when my preassembled refrigerant subcooler is installed near the outside condenser of an air conditioner, the air surrounding the subcooler unit can reach 100°F and higher during hot weather. Heat from this source and from incident solar heat that is transferred to the refrigerant through the outer wall of tube 20 could significantly negate part of the subcooling action. Therefore, I advantageously cover heat exchanger 12, control valve 30, and portions of tubes 22, 24, and 28 with a rigid plastic foam material, which may be, for example, polystyrene foam, which has a low heat conductivity. A typical form for this plastic coating is shown partially cut away in FIG. 1. The preferred form as shown is a rectangular block that is easily handled. A secondary purpose of the foam coating is to protect the elements of my preassembled subcooler from physical damage. In this form, the unit can be easily mounted by means of sheet metal straps if used in an enclosure. Where installation open to the weather is desired, it is preferred to enclose the plastic foam block in a lightweight sheet metal case.

While not pertinent to the internal operation of my preassembled subcooler, it is of interest to mention disposal of the water used for subcooling. This water may be disposed of in an available drain system or, in case of a residential application, a hose bib may be supplied in connection with water outlet tube 24 and a lawn sprinkler attached thereto. The waste water can then be used for watering of lawns or other plant life and therefore serve a useful purpose.

Figure 6:
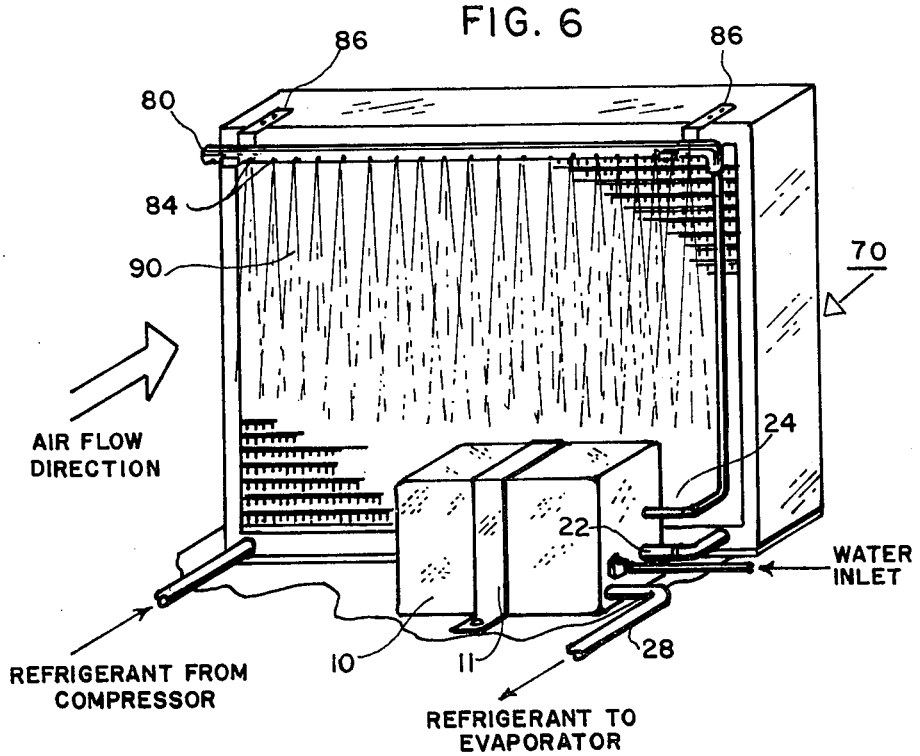
FIG. 6 illustrates my preassembled refrigerant subcooler installed adjacent to an air-cooled condensing unit having a spray device that utilizes the waste water from the heat exchanger to further increase the efficiency of the system through evaporation of the water by the condenser.

An alternative embodiment of my invention advantageously combines a means for disposing of the subcooling water with a means for further improving the operating efficiency of the air conditioning systems into which my preassembled subcooling unit is connected. Referring to FIG. 6, one version of this alternative design will be described. Plastic foam block 10 enclosing heat exchanger 12 is secure to the base of a condenser unit 70 by means of straps 11. Attached to water outlet tube 24 is spray tube 80, to be considered part of this version of my invention. Condenser unit 70 is part of the air conditioning system into which my invention is installed. Spray tube 80 has a series of nozzle holes 84 drilled along its lower length. Holes 84 are arranged to produce a fine spray of water 90 over the condenser tubes and fins during periods for which water is flowing through heat exchanger 12 in accordance with my invention. Spray tube 80 is mounted to condenser 70 by brackets 86 on the side of the condenser 70 upon which air from its blower (not shown) is incident. As water spray 90 strikes the surfaces of condenser 70, evaporation occurs, removing significant amounts of super heat from the refrigerant vapor and liquid refrigerant in condenser 70. As is well known, the evaporative principle is the most efficient approach to design of a condenser, since one pound of water will extract nearly 1000 BTU evaporation. The extraction of these significant amounts of heat from the refrigerant will reduce the load on the system compressor due to a lower highside pressure. The power drain of the compressor motor is consequently reduced, resulting in lower operating costs. The lower condenser pressure also results in a lower saturated liquid temperature, and the work required by the subcooler is reduced. While I have shown a particular type of spray tube 80, alternative spray head arrangements may be tailored to the particular configuration of the condenser to be accommodated.

As may now be understood, my preassembled refrigerant subcooling unit can be installed into an existing air conditioning or refrigeration system. FIG. 6 may be considered to illustrate a typical installation. Refrigerant inlet 22 is connected to the condenser refrigerant outlet, and refrigerant outlet 28 is connected to the line running to the expansion valve and evaporator. If the unit is installed at a time the system is to be recharged, the lines may be brazed or soldered following normal practices; alternatively, standard fittings may be used. For installation into operating systems, special saddle-type connectors can be utilized that obviate the necessity of recharging the system with refrigerant. These connectors are brazed at the desired points along the condenser outlet line and to the subcooler connections. Special cutter bolts are then tightened externally, shearing the line internally to make the connections with the subcooler. The system line between the connectors is then crimped, causing the refrigerant to flow through the subcooler heat exchanger. A water line is installed and connected to a suitable cold-water source, and the desired waste water connection made, completing the installation. Other types and forms of installation will be obvious to those skilled in the art.

The embodiments of my invention herein described are not to be considered limiting, and many variations in design may be made without departing from the scope of my invention.

I claim:

1. A refrigerant subcooling unit adapted to be installable in an existing refrigeration system for subcooling condensed refrigerant in the system to a temperature less than its saturated vaporization temperature, comprising:

heat exchanger means having a first and a second tube, said first tube having an inlet and an outlet forming a flow path for a liquid refrigerant, said second tube having an inlet and an outlet forming a flow path for a cooling medium, said first and second tubes arranged to provide a thermal path therebetween with said inlet of said second tube adjacent to said outlet of said first tube, whereby heat from the liquid refrigerant flowing through said first tube is conducted into the cooling medium flowing in said second tube; and control valve means connected between said second tube and said second tube inlet, said control valve means arranged to be responsive to the temperature of the liquid refrigerant flowing through said outlet of said first tube, thereby controlling the flow of the cooling medium to the minimum necessary to reduce the liquid refrigerant temperature to such selected value.

2. The refrigerant subcooling unit defined in claim 1 in which said heat exchanger means and said control valve means are totally disposed within an insulating block, having said first tube inlet and outlet and said second tube inlet and outlet projecting therefrom, whereby ambient heat is prevented from affecting said heat exchanger means and said control valve means.

3. The refrigerant subcooling unit defined in claim 2 in which said insulating block is composed of polystyrene foam.

4. The refrigerant subcooling unit defined in claim 1 in which said first tube and said second tube are in coaxial relationship.

5. A refrigerant subcooling unit adapted to be installable in an existing refrigeration system for subcooling condensed refrigerant in the system to a temperature less than its saturated vaporization temperature, comprising:

heat exchanger means having a first and a second tube; said first tube having an inlet and outlet forming a flow path for a liquid refrigerant, said second tube having an inlet and an outlet forming a flow path for a cooling medium, said first and second tubes arranged to provide a thermal path therebetween, whereby heat from the liquid refrigerant flowing through said first tube is conducted into the cooling medium flowing in said second tube; and control valve means connected between said second tube and said second tube inlet, said control valve means arranged to be responsive to the temperature of the refrigerant flowing through said outlet of said first tube, said control valve means having a valve housing disposed in said first tube outlet and arranged to be surrounded by the refrigerant, a valve disposed within said valve housing, said valve interposed in said second tube inlet and arranged to control the cooling medium flow therethrough, and a thermostatic power unit operationally connected to said valve, said power unit opening said valve when the surrounding refrigerant temperature is higher then such selected value and closing said valve when the surrounding refrigerant temperature is at or lower then such selected value.

6. The refrigerant subcooling unit defined in claim 5 in which said cooling medium is water, and which further comprises water spray means for discharging said water utilized for subcooling of condensed refrigerant from said heat exchanger, said spray means installable on an aircooled condenser whereby the resulting spray of water incident on heat exchange surfaces of said condenser produces additional cooling of said condenser by evaporation thereby increasing the efficiency of said aircooled condenser.

* * * * *